US010212501B2

(12) United States Patent
Wang et al.

(10) Patent No.: US 10,212,501 B2
(45) Date of Patent: Feb. 19, 2019

(54) MEMS DEVICE WITH A VALVE MECHANISM

(71) Applicant: Goertek.Inc, Weifang, Shandong (CN)

(72) Inventors: Zhe Wang, Weifang (CN); Quanbo Zou, Weifang (CN); Jifang Tao, Weifang (CN)

(73) Assignee: GOERTEK.INC, Weifang, Shandong (CN)

( * ) Notice: Subject to any disclaimer, the term of this patent is extended or adjusted under 35 U.S.C. 154(b) by 128 days.

(21) Appl. No.: 15/505,001

(22) PCT Filed: Aug. 27, 2014

(86) PCT No.: PCT/CN2014/085274

§ 371 (c)(1),
(2) Date: Feb. 17, 2017

(87) PCT Pub. No.: WO2016/029378

PCT Pub. Date: Mar. 3, 2016

(65) Prior Publication Data

US 2017/0280218 A1 Sep. 28, 2017

(51) Int. Cl.
*H04R 25/00* (2006.01)
*H04R 1/08* (2006.01)
(Continued)

(52) U.S. Cl.
CPC ..... *H04R 1/083* (2013.01); *H04R 1/023* (2013.01); *H04R 19/005* (2013.01);
(Continued)

(58) Field of Classification Search
CPC ..... H04R 1/083; H04R 1/023; H04R 19/005; H04R 19/016; H04R 3/007; H04R 19/04; H04R 2201/003
(Continued)

(56) References Cited

U.S. PATENT DOCUMENTS 5,452,268 A * 9/1995 Bernstein ..... H04R 19/005 367/181
6,324,907 B1 12/2001 Halteren et al.
(Continued)

FOREIGN PATENT DOCUMENTS

CN 202178856 U 3/2012
CN 202551279 U 11/2012
(Continued)

OTHER PUBLICATIONS

Written Opinion dated Mar. 31, 2015 in International Patent Application No. PCT/CN2014/085274.
(Continued)

*Primary Examiner* — Phylesha Dabney
(74) *Attorney, Agent, or Firm* — Michele V. Frank; Venable LLP

(57) ABSTRACT

The disclosure provides a MEMS device. The MEMS device comprises a printed circuit board, a cover attached to the printed circuit board to form a housing, at least one sound hole formed in the housing, a transducer with a diaphragm inside the housing, and at least one shutter structure. Each shutter structure is mounted to the housing around a respective sound hole. Each shutter structure comprises a moveable component disposed near the inner surface of the housing, the moveable component remains at an open position under regular pressure such that an air flow path from the sound hole to the at least one ventilation hole of the substrate across the moveable component is opened, and moves to a first closed position under a high external pressure to block the at least one ventilation hole and close the air flow path.

20 Claims, 6 Drawing Sheets

(51) Int. Cl.

| | |
|---|---|
| ***H04R 19/01*** | (2006.01) |
| ***H04R 19/00*** | (2006.01) |
| ***H04R 1/02*** | (2006.01) |
| *H04R 19/04* | (2006.01) |
| *H04R 3/00* | (2006.01) |

(52) U.S. Cl.
CPC ..... *H04R 19/016* (2013.01); *H04R 3/007* (2013.01); *H04R 19/04* (2013.01); *H04R 2201/003* (2013.01)

(58) Field of Classification Search
USPC ..... 381/356, 174
See application file for complete search history.

(56) References Cited

U.S. PATENT DOCUMENTS

| | | | | |
|---|---|---|---|---|
| 6,781,231 | B2 | 8/2004 | Minervini | |
| 7,781,249 | B2 * | 8/2010 | Laming | B81C 1/00158 257/E21.214 |
| 9,006,880 | B1 * | 4/2015 | Minervini | B81B 7/0061 257/704 |
| 9,040,360 | B1 * | 5/2015 | Minervini | H04R 19/016 257/704 |
| 9,794,661 | B2 * | 10/2017 | Watson | H04R 1/023 |
| 2010/0183181 | A1 * | 7/2010 | Wang | H04R 19/005 381/361 |
| 2014/0044297 | A1 * | 2/2014 | Loeppert | H04R 1/04 381/355 |
| 2014/0064542 | A1 | 3/2014 | Bright et al. | |
| 2014/0084396 | A1 * | 3/2014 | Jenkins | B81B 3/0021 257/419 |
| 2016/0176704 | A1 * | 6/2016 | Cargill | H04R 19/005 257/419 |
| 2017/0217760 | A1 * | 8/2017 | Piechocinski | B81B 7/0061 |
| 2017/0217761 | A1 * | 8/2017 | Chung | B81B 7/0061 |
| 2017/0280218 | A1 * | 9/2017 | Wang | H04R 19/016 |
| 2018/0002168 | A1 * | 1/2018 | Cargill | B81C 1/00666 |
| 2018/0273372 | A1 * | 9/2018 | Piechocinski | B81B 3/0072 |

FOREIGN PATENT DOCUMENTS

| | | | |
|---|---|---|---|
| CN | 202587316 | U | 12/2012 |
| CN | 103517169 | A | 1/2014 |
| WO | WO-2013097135 | A1 | 7/2013 |

OTHER PUBLICATIONS

International Search Report dated Mar. 31, 2015 in International Patent Application No. PCT/CN2014/085274.

* cited by examiner

MEMS DEVICE WITH A VALVE MECHANISM

This application is a National Stage of International Application No. PCT/CN2014/085274 filed on Aug. 27, 2014, which is hereby incorporated by reference in its entirety.

TECHNICAL FIELD

The present invention generally relates to a micro-electromechanical system (MEMS) device, more particularly, to a MEMS device with a valve mechanism.

BACKGROUND OF THE INVENTION

MEMS microphones, also known as acoustic transducers, have been in research and development for many years. MEMS microphones have been widely used in many applications, such as cell phones, tablet PCs, cameras, hearing aids, smart toys, surveillance devices, and the like.

U.S. Pat. No. 6,781,231 discloses a MEMS package, comprising surface mountable components (e.g. silicon condenser microphones and integrated circuits), a substrate, and a cover with inner cups and outer cups, the cover being attached to the substrate to form a housing, apertures or acoustic ports formed in the cover for receiving an acoustic signal. An aperture or acoustic port may be regarded as a free "sound port" path for allowing acoustic energy to enter the inside of the housing. Each acoustic port may contain an environmental barrier layer disposed between the inner cup and the outer cup in order to prevent water, particles, and/or light from entering the package and damaging the internal components inside. However, the environmental barrier layer hinders air flow to the inside of the housing through the sound port, reducing the performance of acoustic signals to reach the micro-electromechanical system microphone.

U.S. Pat. No. 6,324,907 B1 discloses a flexible substrate transducer assembly. The flexible substrate provides connectivity between the transducer system and electronic equipment which houses the transducer assembly. A number of through-holes are formed in the second end portion of the flexible substrate to create a first passage to the external environment. An unexpected problem is that the diaphragm of the acoustic transducer in the transducer system is easily damaged due to air pressure pulses caused in drop tests.

International Patent Publication Number WO/2013097135 also discloses a MEMS microphone comprising a silicon substrate and an acoustic sensing part on the silicon substrate. A mesh-structured back hole, having a plurality of mesh beams and a plurality mesh holes defined by the mesh beams and the side wall, is formed in the substrate and aligned with the acoustic sensing part. The mesh-structured back-hole helps streamline air pressure pulses, and thus reduces the impact on the acoustic sensing part; and it can also act as a protective filter to protect alien substances such as particles from entering the microphone.

The drawback of the above two approaches is, however, that alien substances like particles are easily trapped into the diaphragm of MEMS microphone through the sound port such as holes of the flexible substrate and mesh holes of the mesh-structured back hole, especially under high air pressure pulses resulted from drop tests.

SUMMARY OF THE INVENTION

The present invention is directed to a MEMS device with a valve mechanism. The MEMS device may provide a protection for internal components (e.g., transducer chip) from strong air flow pulses or sound pressure.

One object of the present invention is to provide such a MEMS device comprising: a printed circuit board, a cover attached to the printed circuit board to form a housing, at least one sound hole formed in the housing, a transducer with a diaphragm inside the housing, and, at least one shutter structure inside the housing. Each shutter structure may be mounted to the housing around a respective sound hole. Each shutter structure comprises a moveable component having at least one air gap formed therein and a moveable portion; a substrate with at least one ventilation hole formed therein. The moveable component is connected between the substrate and the housing. The moveable portion remains at an open position under regular pressure such that an air flow path from the sound hole to the at least one ventilation hole of the substrate across the at least one air gap of the moveable component is opened, and moves to a first closed position under a high external pressure to block the at least one ventilation hole of the substrate and close the air flow path.

In one alternative embodiment, the at least one sound hole includes a first sound hole formed in the printed circuit board, and the at least one shutter structure includes a first shutter structure corresponding to the first sound hole, and the first shutter structure being disposed over the sound hole of the printed circuit board. Furthermore, the transducer is disposed on the substrate of the first shutter structure.

In another alternative embodiment, the at least one sound hole includes a second sound hole formed in the cover, and the at least one shutter structure includes a second shutter structure corresponding to the second sound hole. The moveable component of the second shutter structure may be bonded to the inner surface of the cover and over the second sound hole, and the transducer is disposed over the printed circuit board.

In one embodiment, each shutter also comprises a first spacer having a first opening enclosed by a wall. The moveable portion is in parallel with the substrate. The first spacer is connected between the substrate and the moveable component to allow for air flow across the first opening to the at least one ventilation hole under regular pressure and the movement of the moveable portion through the first opening under the high external pressure.

In one embodiment, the MEMS device further comprises a second spacer having a second opening enclosed by a wall, wherein the second spacer is connected between the housing and the moveable component of each shutter structure to allow for air flow across the second opening from the sound hole under regular pressure.

In one embodiment, a recess open to the first sound hole is formed in the upper portion of the printed circuit board. The first shutter structure is disposed around the recess and thus the moveable portion of the moveable component is suspended over the recess.

In one embodiment, the moveable component also comprises a stationary portion located at the peripheral edge of the moveable component and connected to the substrate. The moveable portion is located at the central part of the moveable component. The stationary portion is spaced from the moveable portion by the at least one air gap. Optionally, the moveable component also comprises springs connected between the stationary portion and the moveable portion to facilitate the movement of the moveable portion under the high external pressure.

In one embodiment, the movable portion of the moveable component may be one single movable plate or an array of moveable plates.

In one embodiment, the movable portion of the moveable component may be a perforated plate in communication with the sound hole and the at least one ventilation hole.

In one embodiment, the moveable portion of the moveable component of each shutter structure may move to a second closed position to block the corresponding sound hole under a high internal pressure.

In one embodiment, the moveable portion may return to the open position to open the air flow path once the high external or internal pressure is removed.

In one embodiment, the high external or internal pressure may be a sound pressure more than about 500 times the level of regular sound pressure or an air pressure greater than about 1.2 standard atmospheric pressures.

Another object of the present invention is to provide such a MEMS device comprising: a printed circuit board; a cover attached to the printed circuit board to form a housing; a first through-hole formed in the housing; a shutter structure having a moveable portion, a support portion, and at least one air gap formed the moveable portion and the support portion. The shutter structure is disposed around the first through-hole and is bonded to the housing through the support portion to provide an air flow path from the first through-hole to the inside of the housing through at least one air gap of the shutter structure. The moveable portion of the shutter structure remains at an open position under regular pressure to open the air flow path, and moves to a closed position to close the air flow path under a high pressure.

In one embodiment, the shutter structure is bonded to the outer surface of the housing through a first spacer with a first opening enclosed by a wall, and, the moveable portion of the shutter structure moves to the closed position through the first opening to block the first through-hole under the high pressure.

In one embodiment, the shutter structure is bonded to the inner surface of the housing. The support portion of the shutter structure comprises a substrate with at least one ventilation hole in parallel with the moveable portion, a second spacer with a second opening enclosed by a wall, the second spacer being connected between the substrate and the moveable portion, so that air flow may pass through the first through-hole, the at least one air gap, the second opening, and at least one ventilation hole in order and enter the acoustic chamber of the housing under regular pressure, and the moveable portion may move towards substrate through the second opening to block the at least one ventilation hole under the high pressure.

In one embodiment, the MEMS device further comprises a MEMS transducer with a diaphragm disposed over the printed circuit board inside the housing.

In one embodiment, the high pressure may be a sound pressure more than about 500 times the level of regular sound pressure or an air pressure greater than about 1.2 standard atmospheric pressures.

In one embodiment, the shutter structure is applied to a CMOS integrated monolithic microphone device, a MEMS microphone device, or other MEMS devices.

Another object of the present invention is to provide such a microphone device, comprising a transducer element having a diaphragm and a shutter structure. The shutter structure comprises a substrate with at least one hole formed therein, a moveable component having at least one air gap formed therein and a moveable portion, the movable component being bonded to a first surface of the substrate such that an enclosed space is formed between the moveable component and the substrate. The transducer element is bonded to a second surface of the substrate and the diaphragm of the transducer element faces towards the second surface, the second surface being opposite to the first surface. The moveable portion remains at a rest position under regular air pressure to provide an air flow path from the at least one air gap of the moveable portion to the diaphragm of the transducer across the at least one hole of the substrate and move towards the substrate through the enclosed space under a high pressure to block the at least one hole of the substrate.

In one embodiment, the movable portion of the moveable component may be one single movable plate or an array of moveable plates.

According to embodiments of the present invention, a shutter structure may be provided for a MEMS device or a microphone device. The shutter structure may allow an acoustical signal to reach the transducer or other internal components inside the device under normal conditions, but automatically stop relatively high acoustical pressure or strong air flow pulses at very aggressive stress conditions to reach those internal components, and thus provide the MEMS device or microphone device with a valve mechanism to protect its internal components from damage. Moreover, as no conversion to/from other physics, such as electrical, electronic, magnetic, or optical signal is needed, the MEMS device of the invention has advantages of simple structure and low cost and may provide high reliability. The shutter structure can also serve as a protective filter to prevent alien substances like particles from entering the MEMS device if the moveable portion of the shutter is disposed just over the holes through which air flow passes.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION

Figure 1:
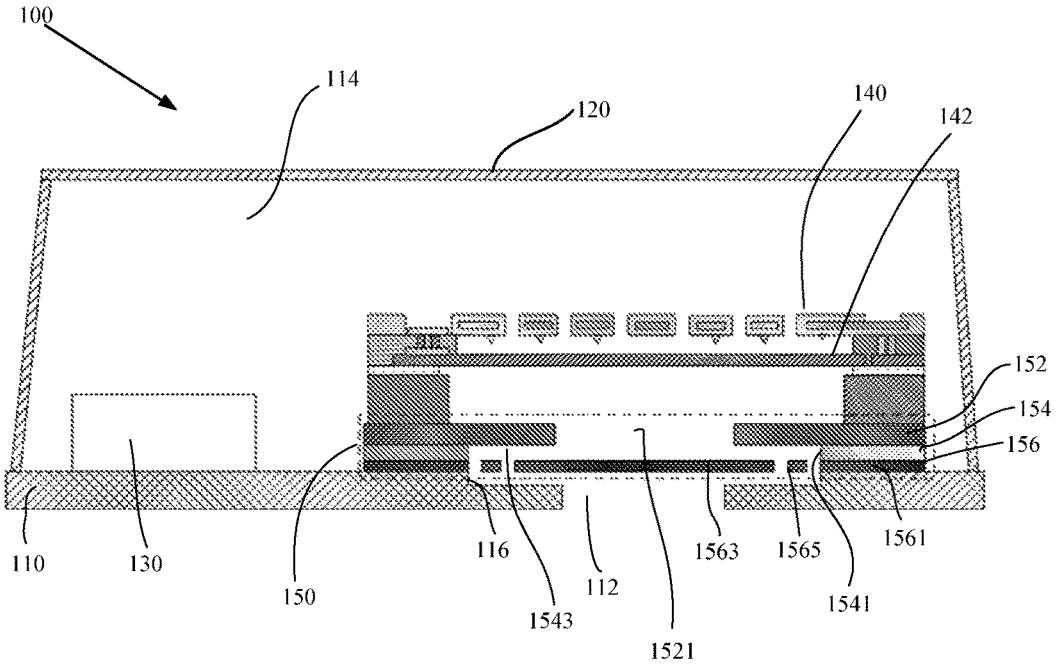
FIG. 1 is a cross-sectional view of the MEMS device according to an embodiment of the invention.

The making and using of some embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosure, and do not limit the scope of the disclosure.

It is understood that the following disclosure provides many different embodiments, or examples, for implementing different features. Specific examples of components and arrangements are described below to simplify the present disclosure. These are of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over a second feature in the description that follows may include embodiments in which the first and second features are formed in direct contact, and may also include embodiments in which additional features may be formed interposing the first and second features, such that the first and second features may not be in direct contact.

Spatially relative terms, such as "below," "lower," "above," "upper", "over" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as being "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein may likewise be interpreted accordingly.

FIG. 1 is a cross-sectional view of the MEMS device according to an embodiment of the invention. With reference now to FIG. 1, the MEMS device 100 comprises a printed circuit board (PCB) 110 having a sound hole 112 formed therein, a cover 120, an ASIC chip 130, a transducer 140, and a shutter structure 150. The cover 120 is attached to the printed circuit board 110 to form an enclosed housing which provides protection for internal elements. The ASIC chip 130, the transducer 140 and the shutter structure 150 are disposed inside the housing. The shutter structure 150 may be disposed at a place over the PCB 110 around the sound hole 112. The transducer 140 is disposed on the shutter structure 150 over the PCB 110. The shutter structure 150 is combined with the housing to form an acoustic chamber 114 for transducer 140.

Figure 2:
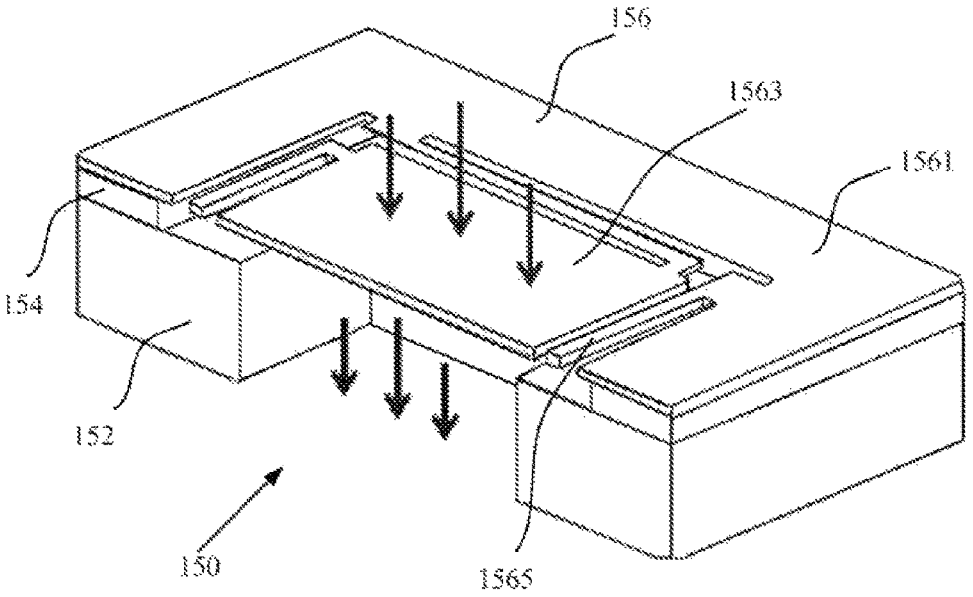
FIG. 2 illustrates a perspective view of part of a shutter structure applied to the MEMS device shown in FIG. 1 according to an embodiment of the invention.
Figure 3:
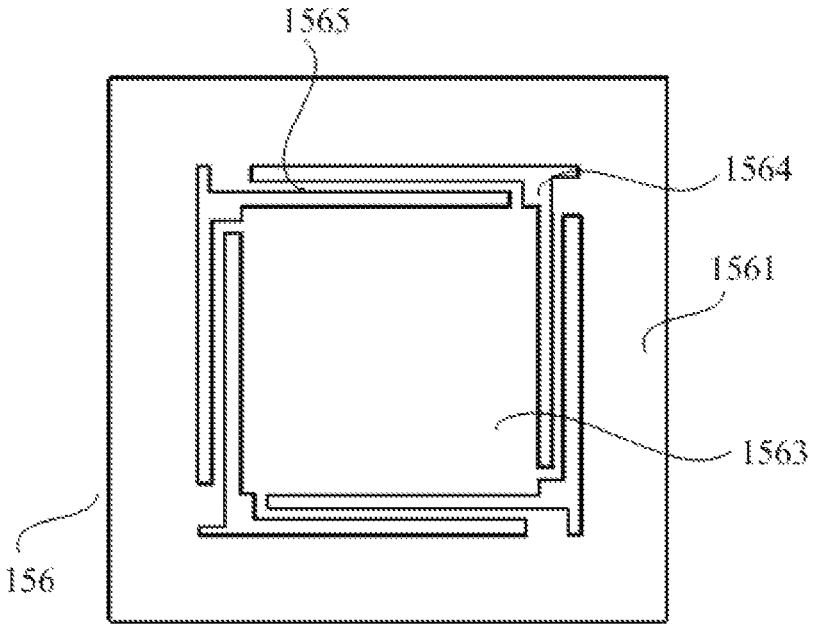
FIG. 3 is the top view of the moveable component of the shutter structure in FIG. 2.

FIG. 2 illustrates a perspective view of part of a shutter structure applied to the MEMS device shown in FIG. 1 according to an embodiment of the invention. FIG. 3 is the top view of the moveable component of the shutter structure in FIG. 2. Referring to FIGS. 1-3, the shutter structure 150 comprises a substrate 152 having a ventilation hole 1521, a spacer 154 having a hollow space 1543 enclosed by a wall 1541, and a moveable component 156. The moveable component 156 may include a stationary portion 1561, a moveable portion 1563, and spring strips 1565. In one embodiment, a few of open slots 1564 may be formed in the moveable component 156 to create spring strips 1565 extending from the stationary portion 1561 to the moveable portion 1563. The stationary portion 1561, the moveable portion 1563, and the spring strips 1565 may be formed by recessing a plate in a predefined pattern by utilizing a process such as etching process, cutting process and the like. The movable portion 1563 is spaced from the stationary portion 1561 by the open slots 1564 and the spring strips 1565 for the purpose of movement of the moveable portion 1563 and air flow across the moveable component 156. The moveable portion 1563 is sized such that it may be allowed to move (or bend) through the hollow space 1543 of the spacer 154. The springs 1565 between the stationary portion 1561 and the moveable portion 1563 may increase the flexibility of the moveable portion 1563, reducing mechanical strength of the moveable portion 1563.

The spacer 154 is disposed on the substrate 152. The stationary portion 1561 of the moveable component 156 is disposed on the wall 1541 (as shown in FIG. 1) of the spacer 154 and thus the moveable portion 1563 is suspended over the hollow space 1543 (as shown in FIG. 1) of the spacer 154. The moveable portion 1563 may move towards the substrate 152 through the space 1543 when a suitable external force is applied to the moveable portion 1563.

Back to FIG. 1, air flow may pass through shutter structure 150 from the sound hole 112 due to the open slots 1564 of the moveable component 156, the hollow space 1543 and the ventilation hole 1521 and enter the acoustic chamber 114 under regular sound pressure level, and no impact on the performance of the MEMS device is caused. Only a relatively high sound pressure or air flow shock may result in big motion of the moveable portion 1563 to block the air flow path to the acoustic chamber, so that the diaphragm and the back plate of the MEMS device can be protected.

Figure 4A:
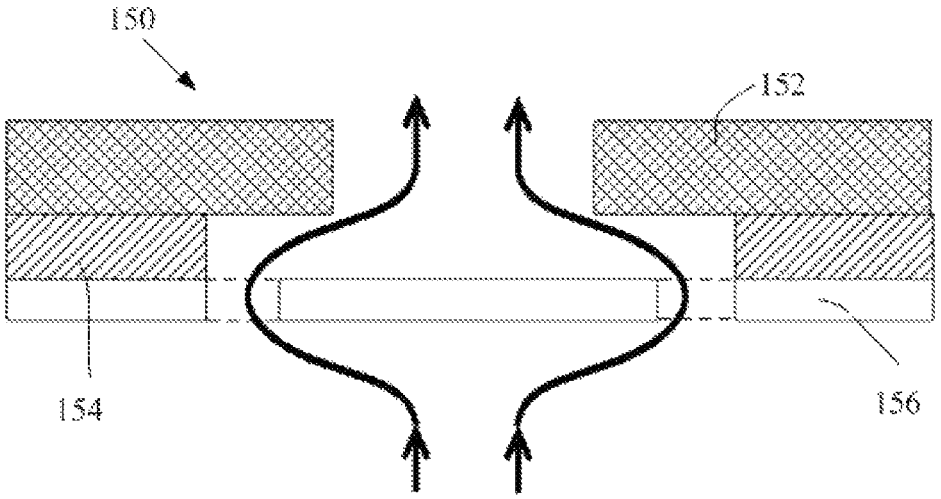
FIGS. 4A and 4B are schematic diagrams illustrating the working principle of the shutter structure according to embodiments of the invention.
Figure 4B:
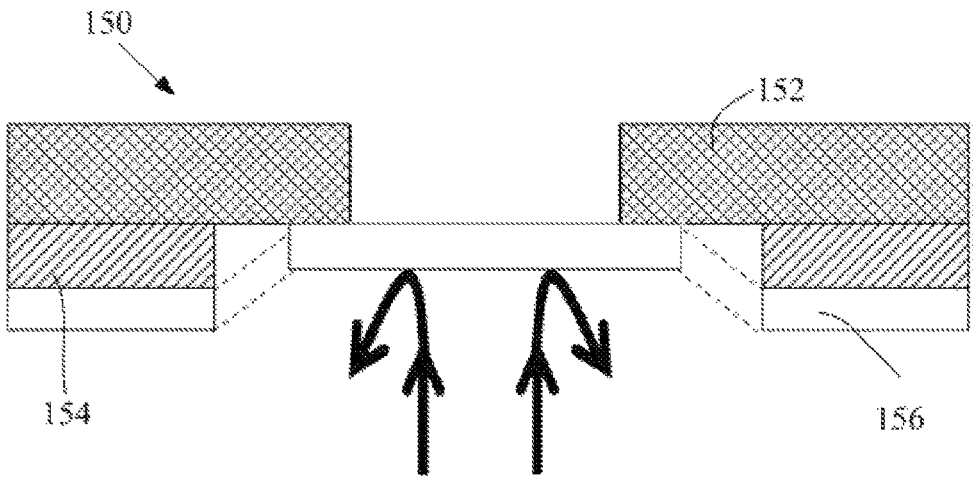

FIGS. 4A and 4B are schematic diagrams illustrating the working principle of a shutter structure according to embodiments of the invention. The shutter 150 includes a moveable component 156, a spacer 154 disposed on the moveable component 156, and the substrate 152 disposed on the spacer 154. Referring to FIG. 4A, under normal sound pressure, the moveable component 156 keeps a rest position (or an open position) to allow for air flow across two air gaps in the moveable component 156, the opening of the spacer 154 and the ventilation hole of the substrate 152. Further referring to FIG. 4B, under a high sound pressure, the moveable portion of the moveable component 156 moves up to a closed position to block the ventilation hole of the substrate 152 and thus the air flow cannot pass through the ventilation hole. The moveable portion of the shutter structure is similar to a valve used in an air passage and thus such a mechanism of controlling air flow may be referred as the valve mechanism.

When the shutter structure 150 as shown in FIG. 2 is mounted on the PCB 110, a space should be reserved between the moveable portion 1563 of the moveable component 156 and the PCB 110 to allow air flow from the sound hole 112 to the ventilation hole 1521 under regular pressure. As shown in FIG. 1, the upper portion of the PCB 110 may be etched to form a recess 116 open to the sound hole 112. The stationary portion 1561 of the moveable component 156 is contacted with the surface of the PCB 110 around the recess 116, and the moveable portion 1563 of the moveable component 156 is then suspended over the recess 116. Thus, air flow or acoustic energy may route from the sound hole 112, the recess 116, the hollow space 1543, and the ventilation hole 1521 of the substrate 152 to the chamber 114. Preferably, the size of the recess may be selected to allow the movement of the moveable portion 1563 within the recess 116. Optionally, the shutter structure 150 may be disposed on the PCB 10 through a support member with a through-hole to allow air flow from the sound hole 112 to the ventilation hole 1521 of the substrate 152 and the movement of the moveable portion 1563 within the through-hole.

The shutter structure 150 responses acoustically and mechanically to environment. Aggressive conditions such as high air pressure pulses resulted from drop tests, high sound pressure, high acceleration vibration (e.g., mechanical shock), or the like may lead to a high pressure, which will be applied to the MEMS device. It should be understood that the terminology 'high pressure' in connection with microphone technology or MEMS technology denotes a pressure which may result in potential or actual damages to internal components of a MEMS device, such as fragile diaphragm and back-plate, cantilever, and other moveable structures in a MEMS package.

For instance, if the MEMS device is subject to high air pressure pulses caused in drop tests, the moveable portion 1563 of the shutter structure 150 for the MEMS device according to the invention may thus be moved towards the substrate 152. Generally, when an air pressure greater than about 1.2 standard atmospheric pressures is applied to the MEMS device of the invention, the moveable portion 1563 can be moved to a closed position to block the ventilation hole 1521 of the substrate 152 and thus close the air flow path from the external environment to the acoustic chamber.

In addition, under regular sound pressure, the shutter structure 150 is open and the MEMS device operates normally, there is no impact on the performance of the MEMS device. However, if the MEMS device is subject to a high sound pressure, for example, more than about 500 times the level of regular sound pressure, the moveable portion 1563 of the moveable component 156 can be moved to block the ventilation hole 1521 of the substrate 152 and thus close the air flow path to protect the MEMS device from shock or impact.

Thereafter, if such aggressive conditions disappear, no external force is applied to the moveable portion, the moveable portion 1563 will thus return to the initial position to open the air flow path due to the action of the springs and the MEMS device gets back to normal work.

Also, if a high internal air pressure is produced and applied to the moveable portion 1563 of the moveable component 156, the moveable portion 1563 will move towards the PCB 10. Furthermore, if the internal air pressure is high enough, the moveable portion 1563 can be moved to block the sound hole 112 of the PCB 110, such that the air flow path is closed.

Figure 5:
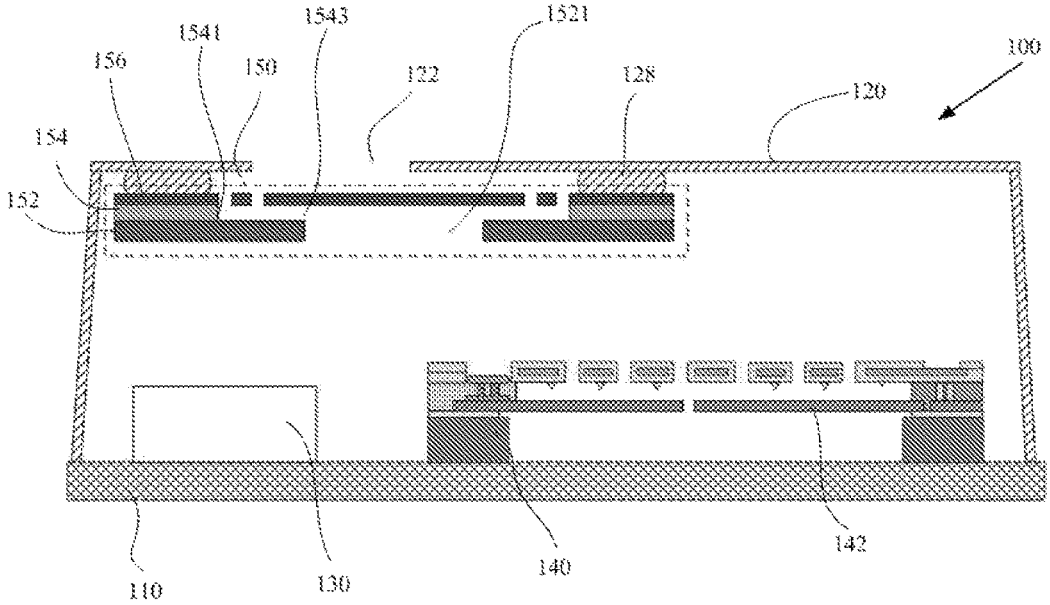
FIG. 5 is a cross-sectional view of another MEMS device according to an embodiment of the invention.

FIG. 5 is a cross-sectional view of another MEMS device according to an embodiment of the invention. Referring to FIG. 5, the MEMS device 100 comprises a PCB 110, and a cover 120 having a sound hole 122 formed therein. The cover 120 is attached to the PCB 110 to form an enclosed housing. An ASIC chip 130 and a transducer 140 are disposed on the PCB 110 inside the housing. A shutter structure 150 is also disposed inside the housing. Rather than being disposed on the PCB 110, the shutter structure 150 is arranged on the cover 120 around the sound hole 122 through a support member 128, and the shutter structure 150 is combined with the housing to create a chamber 114. The support member 28 may be metal or plastic plate, bulk silicon, solder pad, solder bump, or the like. Optionally, the shutter structure 150 shown in FIGS. 2 and 3 may be applied to the MEMS device of the present embodiment through a process such as wafer bonding.

Under normal atmospheric pressure, air flow may route from sound hole 122 to the ventilation hole 1521 of the substrate 152 of the shutter 150 across the space existed in the shutter structure 150. However, under a high pressure, the moveable portion 1563 of the shutter 150 would move to a closed position to block the ventilation hole 1521 of the substrate 152, preventing transducer inside the housing from strong air flow entering the chamber 114.

Figure 6A:
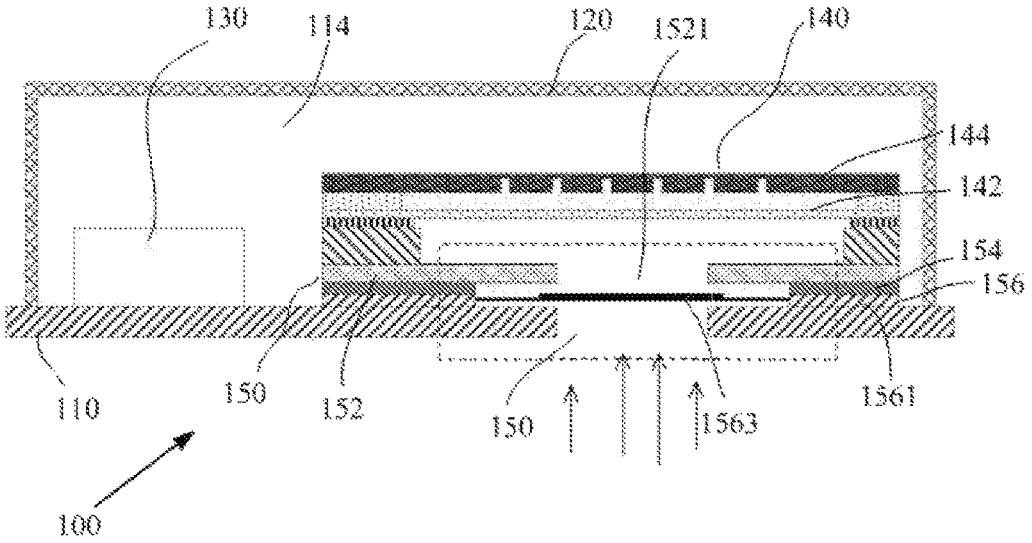
FIGS. 6A and 6B show cross-sectional views of yet another MEMS device according to an embodiment of the invention.
Figure 6B:
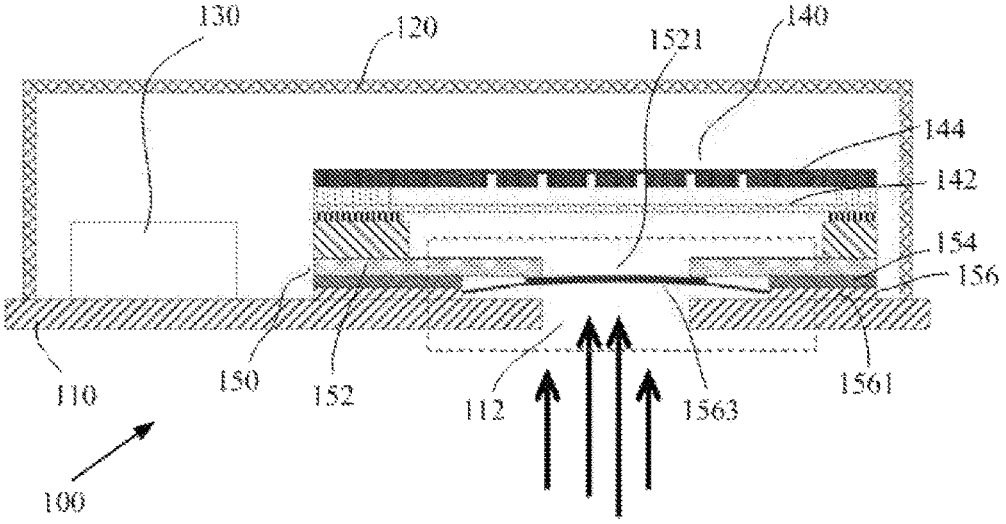

FIGS. 6A and 6B show cross-sectional views of yet another MEMS device according to an embodiment of the invention. Referring to FIG. 6A, the MEMS device 100 comprises a housing consisting of a PCB 110 and a cover 120 attached to the PCB 110. An ASIC chip 130, a transducer 140 having a diaphragm 142 and a back plate 144, and a shutter structure 150 are disposed inside the housing. The shutter structure 150 is disposed on the PCB 110 around a sound hole 112 of the PCB 110 and is used with the housing to create an acoustic chamber 114. The ASIC chip 130 is disposed on the PCB 110 at a place near the shutter structure 150. The transducer 140 is disposed over the shutter structure 150. The shutter structure 150 comprises a substrate 152 with a ventilation hole 1521, a spacer 154 having a wall and an opening enclosed by the wall, and a moveable component 156 having a stationary portion 1561, a moveable portion 1563 connected to the stationary portion 1561, and at least one air gap formed there between. The spacer 154 is disposed on the moveable component 156, and the substrate 152 is disposed on the spacer 154. As shown in FIG. 6A, a space is formed between the substrate 152 and the moveable component 156 due to the opening of the spacer 154.

In this embodiment, the stationary portion 1561 of the moveable component 156 may be directly disposed on the PCB 110. As the stationary portion 1561 is thicker than the moveable portion 1563, the moveable portion 1563 may be suspended over the sound hole 112, so that a space may be formed between the moveable portion 1563 of the shutter structure 150 and the PCB 110 to allow air flow across the moveable component 156. Preferably, the moveable portion 1563 may be in parallel with the PCB 110 under normal air pressure. Similar to the MEMS device shown in FIG. 1, under regular pressure, the moveable portion 1563 of the shutter 150 is located at an open position to open the air flow path, and thus air flow or sound may pass through the air passage consisting of the sound hole 112, the moveable component 156, the opening of the spacer 154, and the ventilation hole 1521 of the substrate 152 and enter the chamber 114. However, if strong air pulses flow across the shutter structure 150 from the sound hole 112, as shown in FIG. 6B, the moveable portion 1563 would bend or move upward to block the ventilation hole 1521 of the substrate 152 due to an external force produced by the strong air pulses. In this case, the air inlet of the MEMS device is closed. If the external force is removed from the moveable component, the moveable portion would return to the initial position and thus the air inlet of the MEMS device is opened.

Figure 7A:
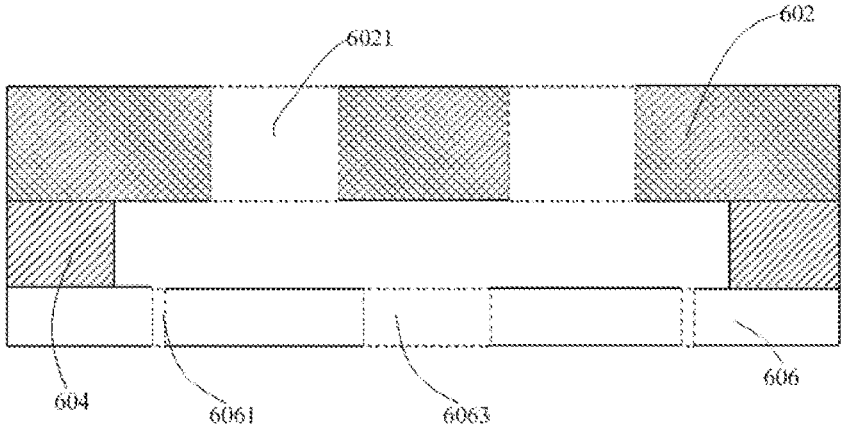
FIG. 7A shows a cross-sectional view of another shutter structure applied to the MEMS device according to an embodiment of the invention.
Figure 7B:
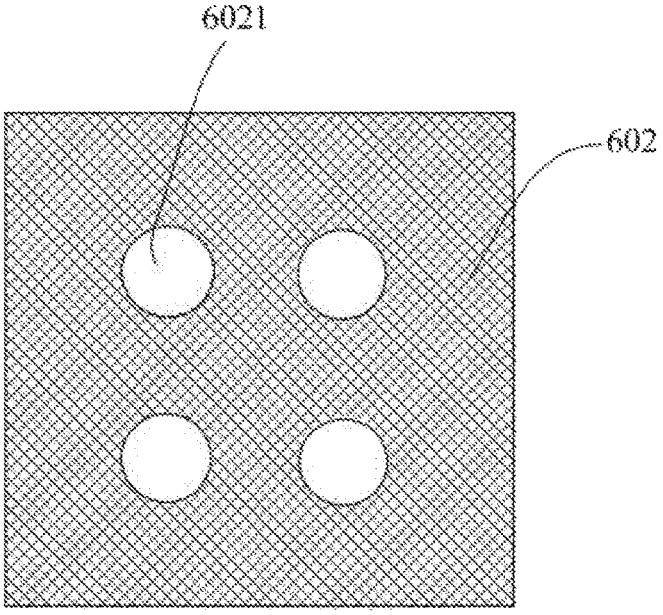
FIGS. 7B-7D each shows the top view of a layer of the shutter structure in FIG. 7A.
Figure 7C:
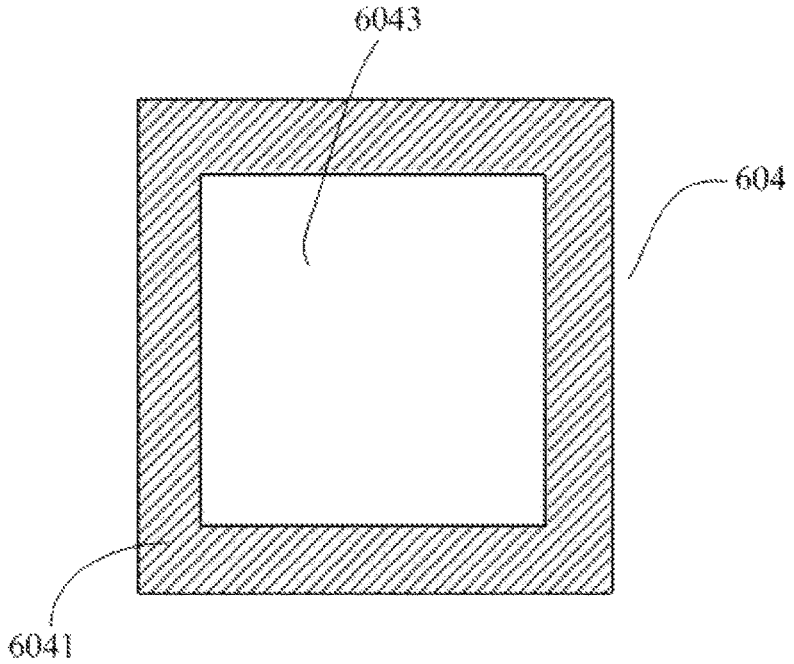
Figure 7D:
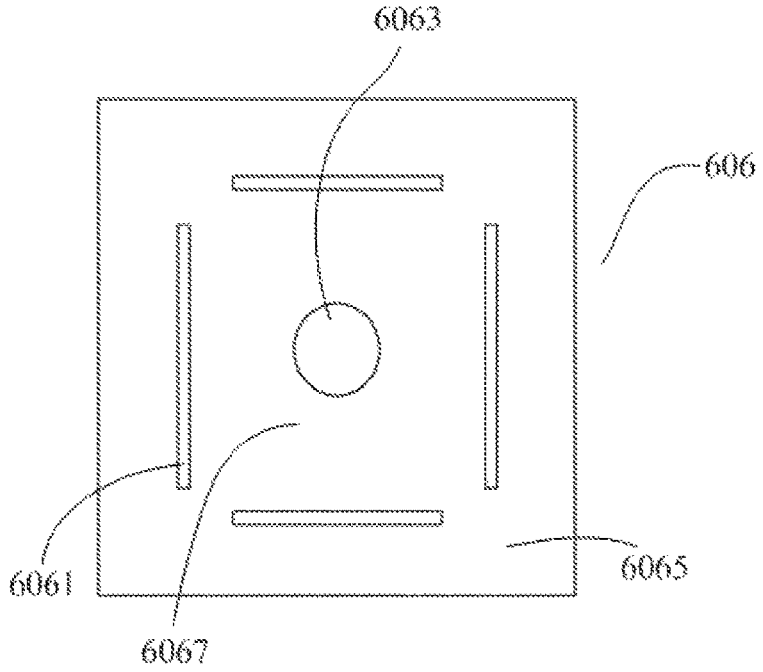

FIG. 7A shows a cross-sectional view of another shutter structure applied to the MEMS device according to an embodiment of the invention. Referring to FIG. 7A, the shutter structure 60 may include a substrate layer 602, a spacer layer 604, and a moveable plate layer 606. The spacer layer 604 is disposed on the moveable plate layer 606, and the substrate layer 602 is disposed on the spacer layer 604. FIGS. 7B-7D each shows a top view of a layer of the shutter structure in FIG. 7A. Referring to FIGS. 7B-7C, the substrate layer 602 has four through-holes 6021, and the spacer layer 604 has an opening 6043 enclosed by a wall 6041. The moveable plate 606 has four slots 6061 and an aperture 6063. Each slot 6061 is formed in parallel with one side of the rectangular moveable plate 606 and the aperture 6063 is located in the central part of the plate 606. The peripheral part of the moveable plate 606 is used as the stationary portion 6065 connected to the wall 6041 of the spacer layer 604, and the central part of the moveable plate 606 is used as the moveable portion 6067 because it may bend upward to cover the four through-holes 6021 under a relatively large force. Once the force is removed, the moveable portion 6067 will return to the initial position due to the characteristic of its material. The shutter structure 60 provided according to the present invention may be assembled in typical packaging process.

In an illustrated example, the moveable plate may be a perforated stainless steel plate having a length and width of about 1.1 mm and a thickness of about 20 um, and when cutting four slots in the steel plate (as shown in FIG. 7D), the deflection of the moveable portion of the moveable plate may go from about 20 um to about 40 um, which would sufficiently cause the moveable portion 6067 to move up to block four through-holes 6021 under aggressive conditions. Optionally, the moveable plate may be rigid plastic sheet (e.g., PET, PVC), and thus the slots in the moveable plate may not be necessary. In one embodiment, the moveable plate may not have the aperture 6063 in the central part. Compared with the plate without the aperture 6063, the perforated plate has smaller acoustic resistance, and brings small impact on low frequency response of the microphone, which makes the microphone device have low noise; however, the defect is that the alien substances like particles may be easily dropped into the inside of the MEMS microphone device.

The shutter of the invention may be made of metal (e.g., alloy), silicon, silicon nitride ($Si_3N_4$), Poly-silicon, glass, ceramics, PCB, polymer, plastic, elastomer, or the like, or a combination thereof.

In embodiments of the invention, a plurality of sound holes may be formed in the housing of the MEMS device, although the MEMS device examples illustrate only one sound hole in the housing. For example, one sound hole is formed in the PCB, another sound hole is formed in the cover. In this case, a plurality of shutter structures may be used in the MEMS device, each shutter structure being disposed around one sound hole. Those shutter structures may restrain diaphragm and other moveable structures in the MEMS device from large deformation under high sound pressure or strong air flow.

In an alternative embodiment of the invention, a shutter structure may also be disposed outside the housing, for example, on the outer surface of PCB 110 around the sound hole 112. In such an embodiment, the shutter structure may comprise a spacer with an opening enclosed by a wall and a moveable component, and the substrate having at least one ventilation hole may be omitted. The spacer of the shutter structure may be bonded to the outer surface of the PCB 110 around the sound hole, and the moveable component may be disposed on the spacer. Under normal pressure, the moveable portion of the shutter structure may remains at an open position to allow air flow or acoustic energy pass through the path consisting of the shutter structure and the sound hole and enter the inside of the housing; under aggressive conditions, the movable portion of the moveable component may be moved (or bended) upward to block the sound hole and close the air flow path. Similarly, in one embodiment, if the cover has a sound hole, a shutter structure may be disposed on the outer surface of the cover around the sound hole.

In one alternative embodiment, the moveable component and the spacer of the shutter may be constructed into an integrated structure instead of two individual components. For example, a raised portion is extended around the peripheral part of the moveable component to form an opening for receiving the moveable portion of the moveable component when moving towards the substrate. In another alternative embodiment, the moveable component, the spacer and the substrate may be constructed into an integrated structure. In yet another alternative embodiment, the moveable portion of the moveable component may be an array of moveable strips spaced from each other by an air gap. It will be understood that the shutter structures described in the disclosure are only illustrative examples, other arrangements or constructions of the shutter structure may be implemented.

Alternatively, the shutter structure provided according to the invention and a transducer may be constructed as a single device for sale. The shutter structure is mounted on a stand-alone transducer element, wherein the diaphragm of the transducer element faces towards the substrate of the shutter structure. The shutter structure may also be applied to CMOS integrated monolithic microphone device. And the shutter structure may also be applied to SOI (silicon-on-insulator) wafer to form a MEMS device different from MEMS microphone device. Furthermore, the shutter structure according to the present invention may be applied to MEMS devices through wafer bonding process.

Although embodiments of the present disclosure and its advantages have been described in detail, it should be understood that various changes, substitutions and alterations can be made herein without departing from the spirit and scope of the disclosure as defined by the appended claims.

Moreover, the scope of the present application is not intended to be limited to the particular embodiments of the process, machine, manufacture, compositions of matter, means, methods and steps described in the specification. As one of ordinary skill in the art will readily appreciate from the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A MEMS device, comprising:

a printed circuit board;

a cover attached to the printed circuit board to form a housing;

at least one sound hole formed in the housing;

a transducer with a diaphragm inside the housing;

at least one shutter structure inside the housing, each shutter structure being mounted to the housing around a respective sound hole, each shutter structure comprising:

a substrate with at least one ventilation hole formed therein, a moveable component having at least one air gap formed therein and a moveable portion, the moveable component being connected between the substrate and the housing, and wherein the moveable portion remains at an open position under regular pressure such that an air flow path from the sound hole to the at least one ventilation hole of the substrate across the at least one air gap of the moveable component is opened, and moves to a first closed position under a high external pressure to block the at least one ventilation hole of the substrate and close the air flow path.

2. The MEMS device of claim 1, wherein:

the at least one sound hole includes a first sound hole formed in the printed circuit board;

the at least one shutter structure includes a first shutter structure corresponding to the first sound hole, and the first shutter structure being disposed over the first sound hole of the printed circuit board; and the transducer is disposed on the substrate of the first shutter structure.

3. The MEMS device of claim 1, wherein:

the at least one sound hole includes a second sound hole formed in the cover;

the at least one shutter structure includes a second shutter structure corresponding to the second sound hole, the moveable component of the second shutter structure being bonded to the inner surface of the cover and over the second sound hole; and the transducer is disposed over the printed circuit board.

4. The MEMS device of claim 1, wherein:

each shutter also comprises a first spacer having a first opening enclosed by a wall;

the moveable portion is in parallel with the substrate; and the first spacer is connected between the substrate and the moveable component to allow for air flow across the first opening to the at least one ventilation hole under regular pressure and the movement of the moveable portion through the first opening under the high external pressure.

5. The MEMS device of claim 2, further comprising:

a second spacer having a second opening enclosed by a wall, wherein the second spacer is connected between the housing and the moveable component of each shutter structure to allow for air flow across the second opening from the sound hole under regular pressure.

6. The MEMS device of claim 2, wherein:

a recess open to the first sound hole is formed in the upper portion of the printed circuit board;

the first shutter structure is disposed around the recess and the moveable portion of the moveable component is suspended over the recess.

7. The MEMS device of claim 1, wherein the moveable component also comprises:

a stationary portion at the peripheral edge of the moveable component, the stationary portion connected to the substrate;

the stationary portion being spaced from the moveable portion at the central part of the moveable component by the at least one air gap.

8. The MEMS device of claim 7, wherein the movable portion of the moveable component may be one single movable plate or an array of moveable plates.

9. The MEMS device of claim 7, wherein the movable portion of the moveable component may be a perforated plate in communication with the sound hole and the at least one ventilation hole; and/or, wherein the moveable component also comprises springs connected between the stationary portion and the moveable portion to facilitate the movement of the moveable portion under the high external pressure.

10. The MEMS device of claim 1, wherein the moveable portion of the moveable component of each shutter structure moves to a second closed position to block the corresponding sound hole under a high internal pressure.

11. The MEMS device of claim 1, wherein the moveable portion may return to the open position to open the air flow path once the high external or internal pressure is removed.

12. The MEMS device of claim 1, wherein the high external or internal pressure may be a sound pressure more than about 500 times the level of regular sound pressure or an air pressure greater than about 1.2 standard atmospheric pressures.

13. A MEMS device, comprising:

a printed circuit board;

a cover attached to the printed circuit board to form a housing, a first through-hole formed in the housing;

a shutter structure having a moveable portion, a support portion, and at least one air gap formed between the moveable portion and the support portion, the shutter structure being disposed around the first through-hole and being bonded to the housing through the support portion to provide an air flow path from the first through-hole to the inside of the housing through at least one air gap of the shutter structure; and wherein the moveable portion of the shutter structure remains at an open position under regular pressure to open the air flow path, and moves to a closed position to close the air flow path under a high pressure.

14. The MEMS device of claim 13, wherein:

the shutter structure is bonded to the outer surface of the housing through a first spacer with a first opening enclosed by a wall; and, the moveable portion of the shutter structure moves to the closed position through the first opening to block the first through-hole under the high pressure.

15. The MEMS device of claim 13, wherein:

the shutter structure is bonded to the inner surface of the housing; and the support portion of the shutter structure comprises:

a substrate with at least one ventilation hole in parallel with the moveable portion, a second spacer with a second opening enclosed by a wall, the second spacer being connected between the substrate and the moveable portion, so that air flow may pass through the first through-hole, the at least one air gap, the second opening, and at least one ventilation hole in order and enter the inside of the housing under regular pressure, and the moveable portion may move towards substrate through the second opening to block the at least one ventilation hole under the high pressure.

16. The MEMS device of claim 13, further comprising:

a transducer with a diaphragm disposed over the printed circuit board inside the housing.

17. The MEMS device of claim 14, wherein the high pressure may be a sound pressure more than about 500 times the level of regular sound pressure or an air pressure greater than about 1.2 standard atmospheric pressures.

18. The MEMS device of claim 14, wherein the shutter structure is applied to a CMOS integrated monolithic microphone device, a MEMS microphone device, or other MEMS devices.

19. An acoustic transducer device, comprising:

a transducer element having a diaphragm;

a shutter structure, the shutter structure comprising:

a substrate with at least one hole formed therein, a moveable component having at least one air gap formed therein and a moveable portion, the movable component being bonded to a first surface of the substrate such that a enclosed space is formed between the moveable component and the substrate, wherein the transducer element is bonded to a second surface of the substrate and the diaphragm of the transducer element faces towards the second surface, the second surface being opposite to the first surface; and wherein the moveable portion remains at a rest position under regular air pressure to provide an air flow path from the at least one air gap of the moveable to the diaphragm of the transducer element across the at least one hole of the substrate and move towards the substrate through the enclosed space under a high pressure to block the at least one hole of the substrate.

20. The acoustic transducer device of claim 19, wherein the movable portion of the moveable component may be one single movable plate or an array of moveable plates.

* * * * *